US007297004B1

(12) United States Patent
Shuhart et al.

(10) Patent No.: US 7,297,004 B1
(45) Date of Patent: Nov. 20, 2007

(54) CRIMPED TUBE ELECTRICAL TEST SOCKET PIN

(75) Inventors: John M. Shuhart, Warminster, PA (US); Timothy L. Kraynak, Hatboro, PA (US)

(73) Assignee: Antares Advanced Test Technologies, Inc., Vancouver, WA (US)

( * ) Notice: Subject to any disclaimer, the term of this patent is extended or adjusted under 35 U.S.C. 154(b) by 0 days.

(21) Appl. No.: 11/671,986

(22) Filed: Feb. 6, 2007

Related U.S. Application Data

(60) Provisional application No. 60/765,549, filed on Feb. 6, 2006.

(51) Int. Cl.
*H01R 12/00* (2006.01)

(52) U.S. Cl. ..... 439/66

(58) Field of Classification Search ..... 439/66, 439/591, 877, 908
See application file for complete search history.

(56) References Cited

U.S. PATENT DOCUMENTS 6,464,511 B1 * 10/2002 Watanabe et al. ..... 439/66
6,758,682 B1 * 7/2004 Kosmala ..... 439/66
6,776,668 B1 * 8/2004 Scyoc et al. ..... 439/700

* cited by examiner

*Primary Examiner*—Tho D. Ta
(74) *Attorney, Agent, or Firm*—Marger Johnson & McCollom, P.C.

(57) ABSTRACT

An electrical conductor comprises a compressible conductive member and a tubular conductive sleeve, wherein the sleeve includes an internal deformation. The compressible member comprises a tubular lattice of interlaced wires received axially within the sleeve and engaged therein by the internal deformation to retain the compressible member axially within the sleeve.

22 Claims, 10 Drawing Sheets

CRIMPED TUBE ELECTRICAL TEST SOCKET PIN

RELATED APPLICATION DATA

This application claims benefit of U.S. Provisional Application Ser. No. 60/765,549, filed 6 Feb. 2006.

FIELD OF INVENTION

The present invention relates to electrical conductors such as those used to connect a semiconductor package to a load board for electrical testing. Specifically, the invention relates to electrical conductors including a compressive member and a sleeve, the sleeve including deformations to retain the compressive member.

BACKGROUND OF INVENTION

Semiconductor chip manufacturers often perform electrical testing of the semiconductor chips at various stages of production, including final testing prior to shipment. This electrical testing may consist of testing chips in package form, in wafer form, or in individual die form. In package form, the semiconductor chips may be encapsulated in an encapsulating resin, with only conductive balls, pads, or leads exposed outside of the package for electrical contact. In wafer and individual die form, the semiconductor chips may have conductive balls or pads available for electrical contact. Typically, the electrical contacts are arranged into an array. Two common types of contact arrays are land grid array and ball grid array. The electrical testing may consist of electrical functionality tests lasting several minutes or it may consist of burn-in or reliability tests lasting many hours. To maximize the efficiency of the testing process, numerous semiconductor chips may be loaded onto a load board and multiple load boards may be rotated through a single piece of test equipment. This allows some load boards to be populated/de-populated with semiconductor chips while other load boards are in the testing area of the test equipment. The semiconductor chips need to be non-permanently affixed to the load board in such a way that the chips can be easily loaded and unloaded from the board while still ensuring good electrical contact to the load board throughout the potentially lengthy testing process. Typically, an interconnect assembly is used to interface the semiconductor chips to the load board. The actual electrical connections between the semiconductor chip and the load board are usually accomplished by compressible pin-type structures within the interconnect assembly. The compressible pins allow for small variations in the structure of the semiconductor chips while still ensuring good electrical contact between the contact arrays on the chip and the load board. The compressible pin structures, sometimes referred to as 'spring pins' or 'pogo pins' can be quite complicated and expensive, consisting of several discrete components, due to the tight tolerances associated with the interconnect assembly and the high reliability demands of the testing process. As an example, a single compressible pin failure can cause many semiconductor chips to be identified as non-functional before the pin failure is identified. Consequently, an interconnect assembly that includes simpler, more reliable, and less expensive electrical contact components is desired. The invention addresses these and other disadvantages of the conventional art.

BRIEF DESCRIPTION OF THE DRAWINGS

The invention is best understood from the following detailed description when read in connection with the accompanying drawing. It is emphasized that, according to common practice, the various features of the drawing are not to scale. On the contrary, the dimensions of the various features are arbitrarily expanded or reduced for clarity. In the description, relative terms such as "horizontal," "vertical," "up," "down," "top," and "bottom" as well as derivatives thereof (for example, "horizontally," "downwardly," "upwardly," etc.) should be construed to refer to the orientation as then described or as shown in the drawing figure under discussion unless otherwise specifically described. These relative terms are for convenience of description and normally are not intended to require a particular orientation. Terms "inwardly," "outwardly," "longitudinal" versus "lateral" and the like are to be interpreted relative to one another or relative to an axis of elongation, or an axis or center of rotation, as appropriate. Terms such as "connected" and "interconnected" refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship. Included in the drawing are the following figures.

DETAILED DESCRIPTION OF THE DRAWINGS

As used herein, the term "semiconductor package" refers to an assembly including at least one semiconductor device (for example, a chip, a die, etc.) supported on a substrate (e.g., a circuit board, a leadframe, etc.).

As used herein, the terms "lattice" or "lattice-like" as applied to a conductor refers to a construction of elongated members (for example, wires) that are arranged to cross each other such that a plurality of openings are defined between the elongated members. The terms "lattice" and "lattice-like", however, are not meant to require any bonding or mechanical coupling between the elongated members at the locations where the elongated members cross each other.

As used herein, the term "sleeve" is as understood in the relevant industry and further may be any structure defining an aperture capable of receiving at least a portion of a compressible conductive member.

As used herein the term "deformation" is as understood in the relevant industry and further may refer to (1) an internal shape or structure of a sleeve, (2) an alteration or modification to an interior surface of a sleeve, or any other deformation or modification adapted to assist in retaining at least a portion of a compressible conductive member within an aperture defined by the sleeve.

As used herein the term "crimp" is as understood in the relevant industry and further may refer to a physical alteration of a sleeve causing a hampering or obstructive effect upon a compressible conductive member within an aperture defined by the sleeve that assists in retaining at least a portion of the compressible conductive member.

Certain integrated circuit (IC) packages or modules include semiconductor devices, such as chips or dies, contained in an encapsulating material or housing. The IC package or module may include an exterior array of contacts, or input/output pads, for electrically connecting the package or module to another electronic component, such as a load board adapted for use with a package testing system. The contacts of an IC package typically are not connected directly to the load board. Typically, an interconnect assembly (e.g., a test socket) may be interposed between the IC package and the load board to provide electrical connection between the contact array of the IC package and a contact array of the load board.

Figure 1:
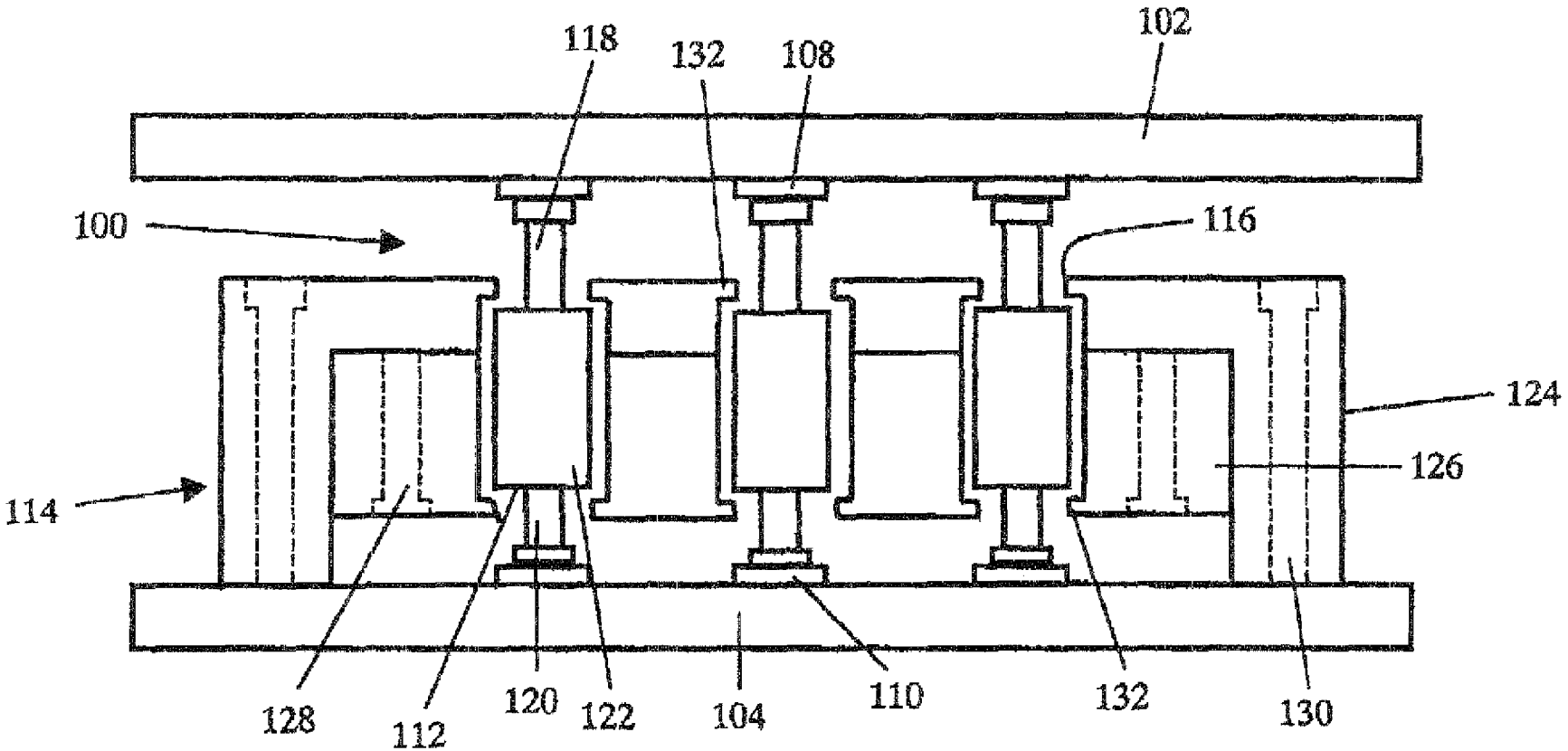
FIG. 1 is a side sectional view of an interconnect assembly located between an integrated circuit (IC) package and a load board adapted for use with a package testing system, the IC package having a land grid array of contacts.

Referring again to the drawings where like numerals refer to like elements, there is illustrated in FIG. 1, for example, interconnect assembly 100 located between IC package 102 and load board 104 adapted for use with a package testing system. IC package 102 may include an array of electrical contacts 108 located on an exterior surface of package 102. The exemplary array of contacts 108 is of a type known as a "land grid array" in which contacts 108 have substantially planar contact surfaces. Load board 104 also may include an array of electrical contacts 110.

Interconnect assembly 100 may include a plurality of conductors 112 received in openings 116 defined by support frame or carrier 114. As shown, openings 116 of carrier 114 may be spaced to provide for substantial alignment between conductors 112 and contacts 108, 110 of package 102 and load board 104, respectively. Each conductor 112 may be compressible to provide a variable length for conductor 112. Such adjustable conductor length allows interconnect assembly 100 to accommodate dimensional variations, for example amongst contacts 108, 110. Such dimensional variation may result in variation in the separating distance between pairs of contacts 108, 110 when package 102 and load board 104 are brought into contact with interconnect assembly 100 as shown in FIG. 1. The adjustable length for conductors 112 may ensure that each conductor 112 of interconnect assembly 100 will contact package 102 and load board 104.

Each conductor 112 of interconnect assembly 100 may include plunger members 118, 120 defining opposite ends of conductor 112, and cylindrical barrel 122 located between plunger members 118, 120. A coil spring or other resilient member (not shown) may be coupled between plunger members 118, 120 and contained within barrel 122. Compression of the coil spring under loading placed on plunger members 118, 120 may result in the desired shortening of the distance between opposite ends of conductor 112. This type of conductor having elongated plungers, a barrel and a coil spring is sometimes referred to as a "spring pin" or "pogo pin."

Carrier 114 of interconnect assembly 100 may include socket portion 124 and retainer portion 126 secured together by fasteners at locations 128. Carrier 114 of interconnect assembly 100 may be secured to load board 104 by fasteners at locations 130. Each carrier portion 124, 126 may define respective annular shoulders 132 adjacent openings 116 for retaining barrels 122 of conductors 112 within openings 116. As illustrated in FIG. 1, barrel 122 of each conductor 112 may be dimensioned to define a gap between conductor 112 and annular shoulders 132. This gap may provide vertical play between carrier 114 and barrel 122 of each conductor 112.

Figure 2:
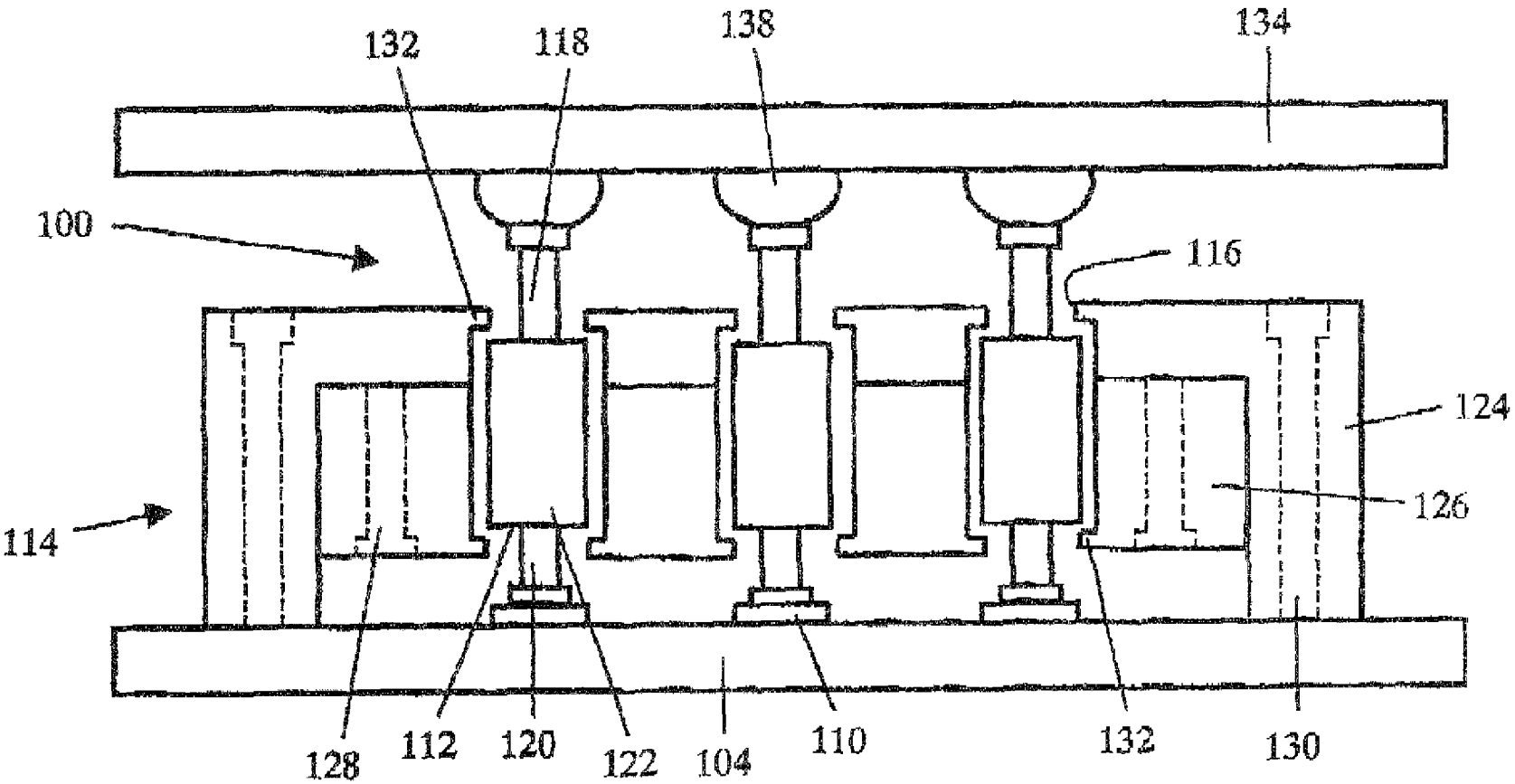
FIG. 2 is a side sectional view of the interconnect assembly of FIG. 1 located between the load board of FIG. 1 and an IC package having a ball grid array of contacts.

Referring to FIG. 2, for example, interconnect assembly 100 of FIG. 1 may be located between load board 104 and IC package 134. Instead of including a land grid array of contacts like package 102, package 134 may include an array of contacts 138 having a rounded configuration. This type of contact array is sometimes referred to as a "ball grid array."

Figure 3:
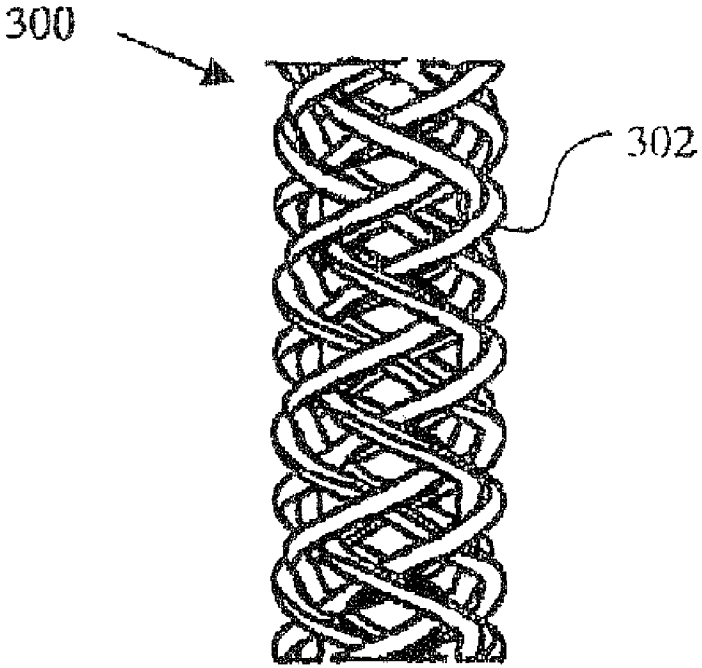
FIG. 3 is a side view of a compressible member according to an exemplary embodiment of the present invention for use with an electrical conductor/interconnect assembly for electrically connecting circuit members.

Referring to FIG. 3, for example, there is shown compressible electrical conductor 300 for electrically connecting circuit members (for example, a semiconductor package and a load board). Depicted compressible conductor 300 may include eight discrete wires 302 interlaced with each other, such as by braiding the wires, to form a substantially tubular structure. The interlacing of wires 302 may result in a lattice-like construction in which wires 302 cross each other to define a plurality of openings between the wires. Each interlaced wire 302 of depicted compressible conductor 300 may be deformed during fabrication of the conductor to extend along a helical path. Wires 302, however, may undergo only substantially elastic deformation during manufacture such that plastic deformation may be minimized.

Interlaced wires 302 may then be annealed during manufacture of compressible conductor 300 to provide stress relief, particularly at the locations where adjacent wires 302 overlap each other. In the exemplary embodiment illustrated in FIG. 3, there may be no bonding or other mechanical interconnection between wires 302, however, such that the wires remain free to move (e.g., slide) with respect to each other when conductor 300 may be compressed under an applied load. The stress relief provided by the annealing may remove associated elastic strain within wires 302, such that the wires will tend to remain together in the unitary, tubular, construction shown rather than springing apart when a length of the interlaced-wire construction may be cut to provide individual conductors, such as conductor 300 of FIG. 3, for example, of desired length.

The tubular construction of depicted compressible conductor 300 desirably may provide a simplified construction compared to the spring pin or pogo pin having opposite plunger members, an intermediate barrel and a coil spring coupled between the plunger members and contained within the barrel. Also, the tubular construction of depicted compressible conductor 300 may provide a universal construction in which compression can occur along the entire length of the conductor. This differs from the pogo pin construction having substantially rigid plunger members in which compression may be concentrated to the intermediately located spring member contained within the barrel. The construction and properties of electrical conductor 300 is described in greater detail in co-pending U.S. application Ser. No. 10/736,280, filed Dec. 15, 2003, which claims priority of U.S. provisional applications No. 60/457,076, filed Mar. 24, 2003, No. 60/457,258, filed Mar. 25, 2003, and No. 60/462,143, filed Apr. 8, 2003, each incorporated by reference in its entirety. It should be understood that the present invention is not limited to depicted compressible conductor 300. Alternative constructions are conceived, such as interlaced-wire tubes including more, or fewer, than eight wires 302 and conductors made from flat meshes of interlaced wire that may be rolled into a tubular form. Further, the teachings of the present invention are applicable to other types of compressible conductors such as conductive springs or the like.

Figure 4:
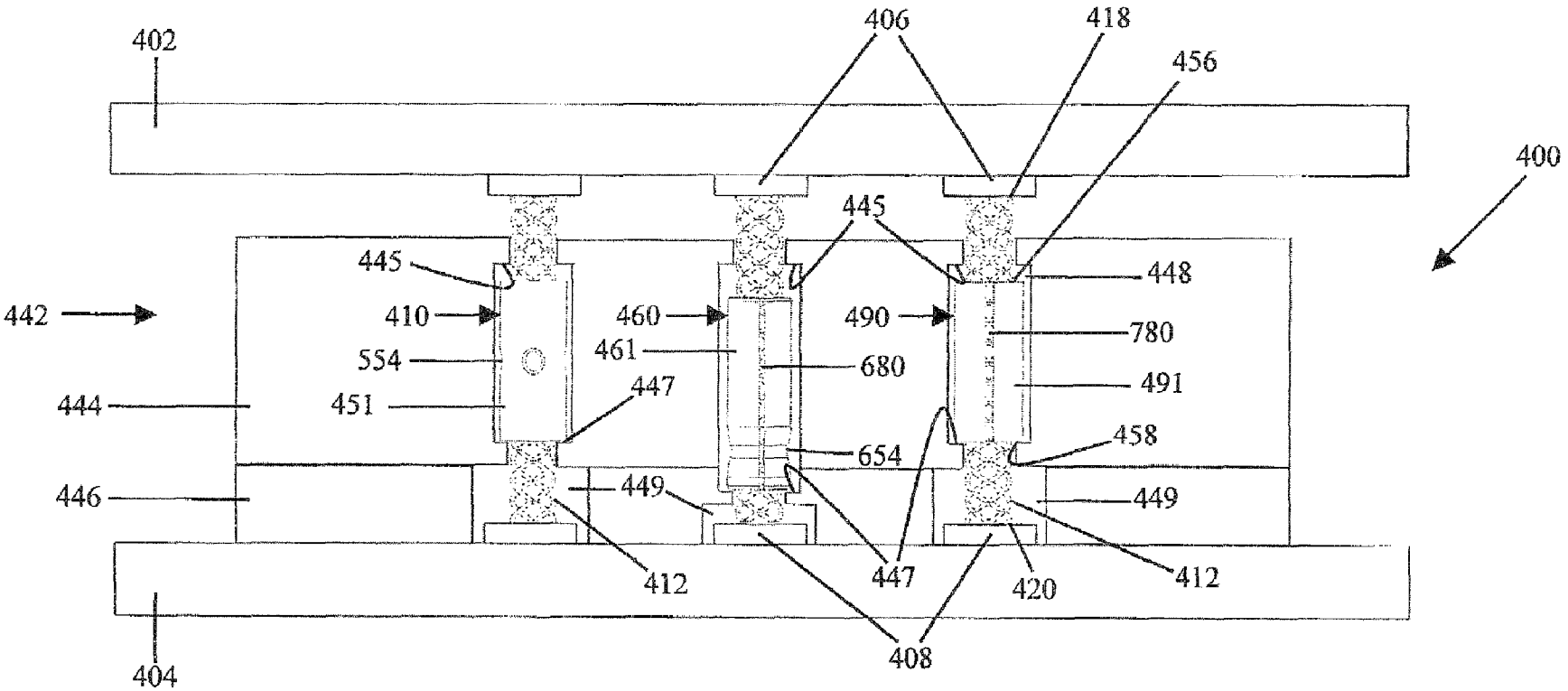
FIG. 4 is a side sectional view of an interconnect assembly according to an exemplary embodiment of the present invention shown electrically connecting circuit members having arrays of electrical contacts.

Referring to FIG. 4, according to an exemplary embodiment of the invention, interconnect assembly 400 is illustrated electrically connecting two circuit members 402, 404. According to one non-limiting example, circuit members 402, 404 may be, respectively, semiconductor package 402 and load board 404 adapted for use with a package testing system. In similar fashion as package 102 and load board 104 of FIGS. 1 and 2, for example, package 402 and load board 404 may include respective arrays of contacts 406, 408 for engagement with interconnect assembly 400, as described below in greater detail. It should be understood that the present invention is not limited to use with circuit members having electrical contacts of any particular configuration. The arrays of electrical contacts of circuit members 402, 404, for example, may comprise a land grid array (e.g., the array of electrical contacts 108 of package 102 illustrated in FIG. 1), a ball grid array (e.g., the array of electrical contacts 138 of package 134 illustrated in FIG. 2), or arrays of electrical contacts having other configurations.

Interconnect assembly 400 also includes a plurality of electrical conductors 410, 460, 490 arranged in a spaced arrangement. The spaced arrangement of conductors 410, 460, 490 may substantially correspond to the spaced arrangement for electrical contacts 406, 408, respectively, of circuit members 402, 404. This arrangement provides for contact between conductors 410, 460, 490 and contact arrays 406, 408 of circuit members 402, 404, as illustrated in FIG. 4, for example. It is noted that first, second and third electrical conductors 410, 460, 490 illustrated in FIG. 4 may each be according to a separate exemplary embodiment of the present invention and are illustrated on the same interconnect assembly 400 for convenience and while is it contemplated that different embodied electrical conductors may be assembled in a single such interconnect assembly 400, only one type exemplary embodiment conductor may comprise each conductor 410, 460, 490. Interconnect assembly 400 specifically illustrated in FIG. 4, for example, has only three conductors 410, 460, 490 spaced across carrier 442 to facilitate description. It should be understood, however, that an interconnect assembly according to the invention may include an arrangement of conductors that includes few conductors or, alternatively, up to tens of thousands of conductors or more. Electrical conductors 410, 460, 490 may be referred to herein as "first (electrical) conductor 410," "second (electrical) conductor 460" and "third (electrical) conductor 490," respectively. This is only for the purposes of ease of description and understanding.

Each respective electrical conductor 410, 460, 490 includes elongated compressible member 412. Depicted compressible members 412 includes an interlaced-wire construction such as that of compressible conductor 300 of FIG. 3, for example.

Socket member 444 of carrier 442 defines a plurality of apertures 448 each receiving an upper portion of one of the conductors. Retainer 446 of carrier 442 defines a plurality of apertures 449 each receiving a lower portion of one of the conductors. Respective apertures 448, 449 of socket member 444 and retainer 446 are substantially aligned, axially, with each other. As illustrated in FIG. 4, for example, apertures 448 of socket member 444 of carrier 442 have a diameter that may be larger than an outer diameter of compressible members 412, and larger than an outer diameter of sleeves 451, 461, 491 of respective conductors 410, 460, 490, such that annular gaps are defined between conductors 410, 460, 490 and apertures 448 of socket member 444. Such an analogous annular gap may exist for the lower portion of second conductor 461 vis a vis an upper portion of aperture 449 of retainer 446 proximate second conductor 461 as illustrated in FIG. 4, for example.

Electrical conductors 410, 460, 490 may be press fit within respective apertures 448, 449 of socket member 444 and retainer plate 446 of carrier 442 such that the electrical conductors may be retained within the apertures and permitting the opposing ends of compressible members 412 to freely compress and decompress within respective within apertures 448, 449.

As noted below for second and third electrical conductors 460, 490, respective longitudinal openings 680, 780 may permit placement/insertion within apertures 448, 449 permitting greater tolerances of those apertures 448, 449 as respective sleeves 461, 491 may be further constricted to account for the greater tolerances of apertures 448, 449. Socket member 444 and retainer 446 of carrier 442 may each also provide shoulders 445, 447 that may contact respective ends 456, 458 of sleeves 451, 461, 491. In an exemplary embodiment of the present invention, there may be a gap(s) between shoulders 445, 447 and respective ends 456, 458 of sleeves 451, 461, 491 such that shoulders 445, 447 limit vertical movement of sleeves 451, 461, 471 there between.

Socket member 444 and retainer 446 of depicted carrier 442 may each be made from a non-conductive material, such as polytetrafluoroethylene (PTFE) for example, to provide for sliding receipt of the respective upper and lower portions of compressible members 412 of conductors 410, 460, 490 without jeopardizing the electrical pathways defined through the conductors. It is contemplated that carrier 442 may be a one piece carrier (and made from a non-conductive material, such as PTFE, for example) having respective single apertures, corresponding to aligned apertures 448, 449, for receipt of electrical conductors 410, 460, 490.

Compressible member 412 of each conductor 410, 460, 490 may be made from an electrically conductive material, such as gold-plated copper, for example. Sleeves 451, 461, 491 of each respective conductor 410, 460, 490 may also made from an electrically conductive material.

As referenced above, each electrical conductor 410, 460, 490 includes respective sleeves 451, 461, 491 each having aperture 452 (not illustrated in FIG. 4) which is adapted to receive at least a portion of respective compressible members 412 as illustrated in FIG. 4. Each sleeve 451, 461, 491 includes at least one respective deformation 554; 654; 792, 492 adapted to assist in retaining at least a portion of compressible member 412 received within aperture 452. The respective sleeves may be substantially rigid compared to the compressible member of the conductors. Compressible members 412 extend outwardly from respective opposing ends 456, 458 of the sleeves to define upper and lower ends 418, 420 of the conductors. Compressible members 412 and sleeves 451, 461, 491 of each conductor 410, 460, 490 are arranged, in the manner described, such that a conductive path is provided through each of conductors 410, 460, 490 between upper and lower ends 418, 420 of conductors 410, 460, 490.

Deformations 554; 654; 792, 792', 792", 492 may be, for example: (1) a crimp, such as a constriction or the like 554; 654 in sleeve 451, 461 of first and second conductors 410, 460; (2) an internal flange or the like 792, 492 (not illustrated in FIG. 4) within sleeve 491 of third conductor 490; or (3) one or more internal projections or tabs 792', 792" (not illustrated in FIG. 4) within sleeve 491 of third conductor 490; such that the deformations may contact a portion of respective compressible members 412 received within respective sleeves 451, 461, 491 to assist in retaining a portion of the compressible member within the sleeves. Such deformations 554; 654; 792, 792', 792", 492 may, for example, cause a friction contact or fit against respective compressible members 412. Deformations 554; 792, 792', 792", 492 may be at roughly the midpoint between respective opposing ends 456, 458 of respective sleeves 451, 491 as also illustrated in FIGS. 5A, 5B; 7B, 7C and 7D for first and third conductors 410; 490, for example, or, deformation 654 may be more proximate one end 456, 458 of sleeve 461 as also illustrated in FIGS. 6A and 6B for second conductor 460, for example.

Figure 6B:
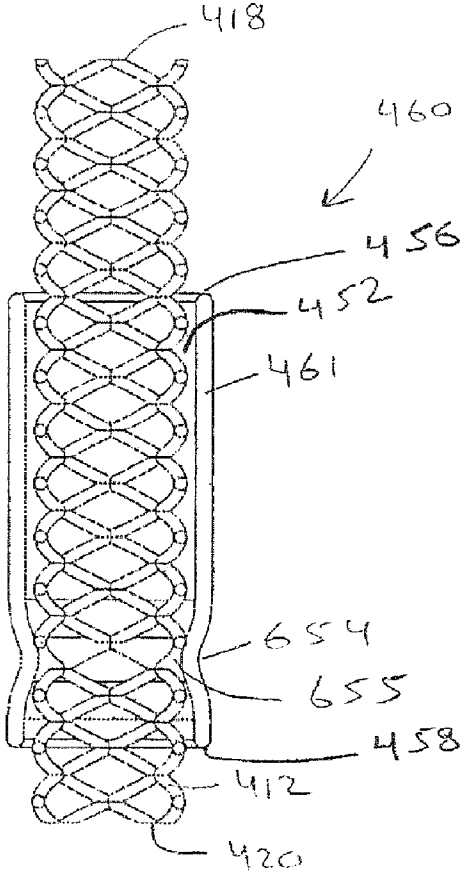
FIG. 6B is a longitudinal sectional view of FIG. 6A.
Figure 6A:
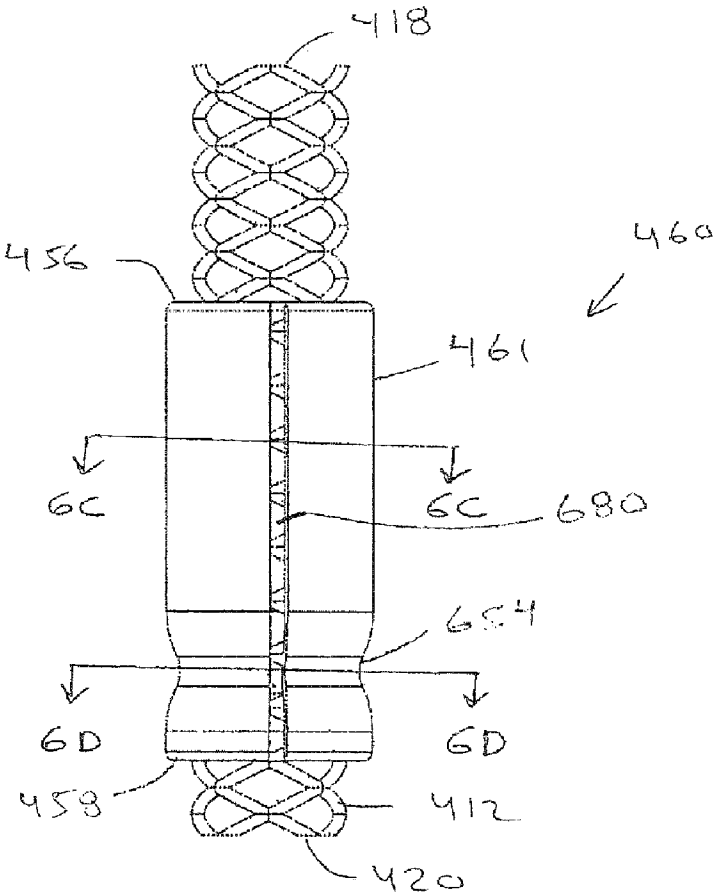
FIG. 6A is a perspective view of an electrical conductor according to an exemplary embodiment of the invention for use with an interconnect assembly for electrically connecting circuit members.

For second conductor 460, deformation 654 is proximate lower end 458 of sleeve 461 as also illustrated in FIGS. 6A, 6B, for example, to permit additional compression, or play, of the upper portion of compressible member 412 contacting upper circuit member 402 (circuit member/semiconductor device under test (DUT)) to account for a greater variation in planarity/coplanarity of its contacts 406. It is understood that the planarity/coplanarity of contacts 408 of lower circuit member 404 (load board) may be within better tolerances and so less compression/play of the lower portion of compressible member 412 may be needed.

Figure 5C:
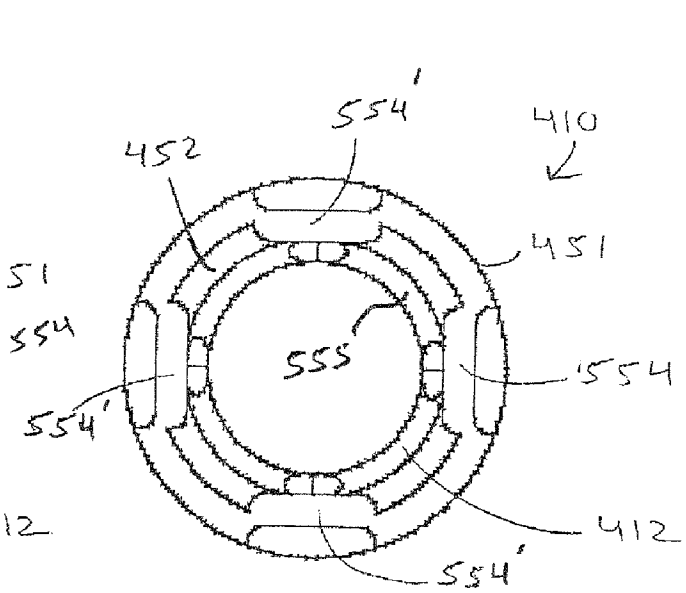
FIG. 5C is a cross-sectional view of FIG. 5A along line 5C-5C.
Figure 5B:
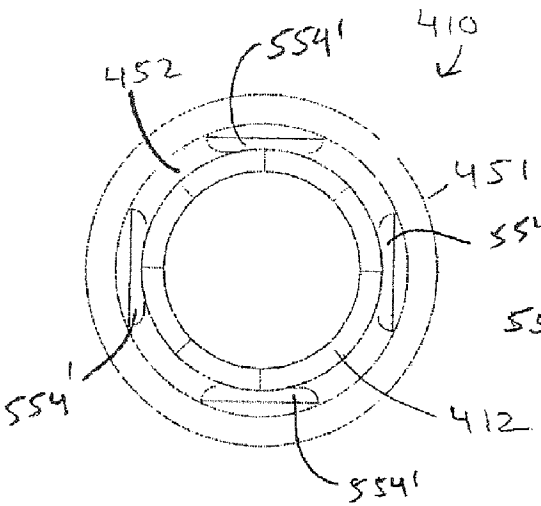
FIG. 5B is a cross-sectional view of FIG. 5A along line 5B-5B.
Figure 5A:
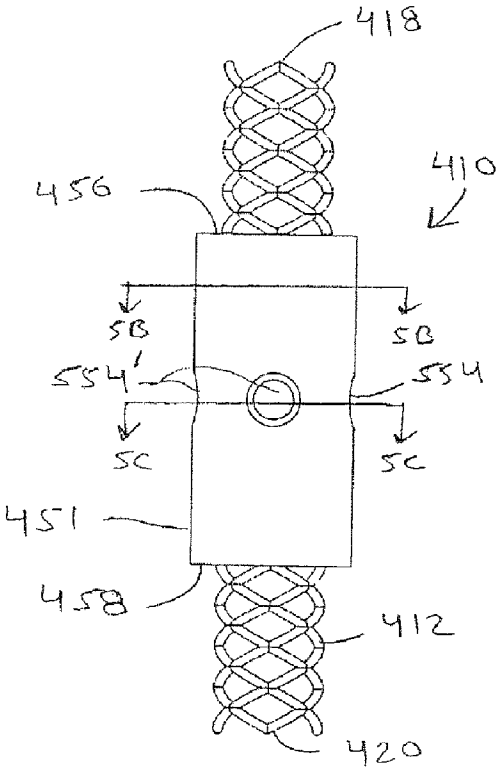
FIG. 5A is a perspective view of an electrical conductor according to an exemplary embodiment of the invention for use with an interconnect assembly for electrically connecting circuit members.

It is noted and understood that the position of deformation 554; 654; 792, 492 for each of respective first, second and third conductors 410, 460, 490 may not be limited as illustrated in respective FIGS. 5A, 5B, 5C; 6A, 6B, 6C; 7A, 7B, 7C and 7D, for example.

There may be multiple deformations 554; 792, 792', 792", 492. For example: (1) multiple crimps or constrictions 554, 554' in sleeve 451 (as illustrated in FIG. 4 and also in FIGS. 5A, 5B and 5C, for example, for second conductor 410); or (2) multiple internal projections or tabs 792', 792" (as also illustrated in FIG. 7D, for example, for third conductor 490). Deformation 654, 492 may also extend along all or a part of the circumference of sleeve 461, 491 as illustrated in FIGS. 6A, 6B; and 7C et al., for example, respectively illustrating: (1) second conductor 460 showing deformation 654 about what may be essentially the entire circumference of a sleeve (461); and (2) third conductor 490 showing deformation 492 about what may be essentially the entire inner circumference of sleeve 491. For third conductor 490, deformation 492 may extend about the internal circumference of sleeve 491 excepting for the portion of longitudinal slot 780.

Referring now specifically to FIG. 5A, according to an exemplary embodiment of the present invention, there is illustrated first electrical conductor 410 having compressible member 412 retained within sleeve 451 by one or more deformations 554, 554'. Sleeve 451 includes upper and lower ends 456, 458 and compressible member 412 includes upper and lower ends 418, 420 which also defines the upper and lower ends 418, 420 of first conductor 410.

Referring to FIG. 5B, according to an exemplary embodiment of the present invention, there is illustrated a sectional view of FIG. 5A along line 5B-5B showing one or more deformations/crimps 554, 554' proximate the mid-point of sleeve 451 contacting at least a portion of compressible member 412 there below the point of the cross section 5B-5B.

Referring to FIG. 5C, there is illustrated a cross-sectional view of FIG. 5A along line 5C-5C showing deformation 554, such as a crimp, for example, contacting a portion of compressible member 412. Also illustrated are one or more additional deformations 554', such as crimps, for example, that may be spaced approximately 90° (ninety degrees) apart from deformation 554/each other. It is contemplated that deformation 554 and additional deformation 554' may be spaced approximately 180° (one hundred eighty degrees) apart or in some other spaced arrangement. Portion 555 of compressible member 412 is contacted by deformation(s) 554 (554') of sleeve 451 to retain compressible member 412 within sleeve 451.

Specifically now referring to FIG. 6A, according to another exemplary embodiment of the present invention, there is illustrated second electrical conductor 460 having compressible member 412 retained within sleeve 461 by deformation 654. Sleeve 461 includes upper and lower ends 456, 458 and compressible member 412 includes upper and lower ends 418, 420 which also defines the upper and lower ends 418, 420 of second conductor 460. Second conductor 460 further defines longitudinal slot/opening 680 that extends at least part way between opposing ends 456, 458 of sleeve 461 and may extend completely from opposing ends 456, 458 as illustrated, for example.

Longitudinal slot 680 may serve to permit a greater reduction in the overall circumference of sleeve 461, constricting sleeve 461 when second conductor 460 is placed within aperture 448 of carrier 442 (see below). Longitudinal slot 680 and deformation 654 may be sized such that when second conductor 460 is placed within carrier aperture 448 (reducing longitudinal slot 680 and thus reducing the overall circumference of sleeve 461 to constrict sleeve 461) compressible member 412 may not be appreciably contacted by the interior of constricted sleeve 461 except at deformation 654.

Referring to FIG. 6B, for example, there is illustrated a longitudinal sectional view of FIG. 6A showing circumferential deformation/crimp 654 proximate lower end 458 of sleeve 461 contacting at least portion 655 of compressible member 412.

Figure 6C:
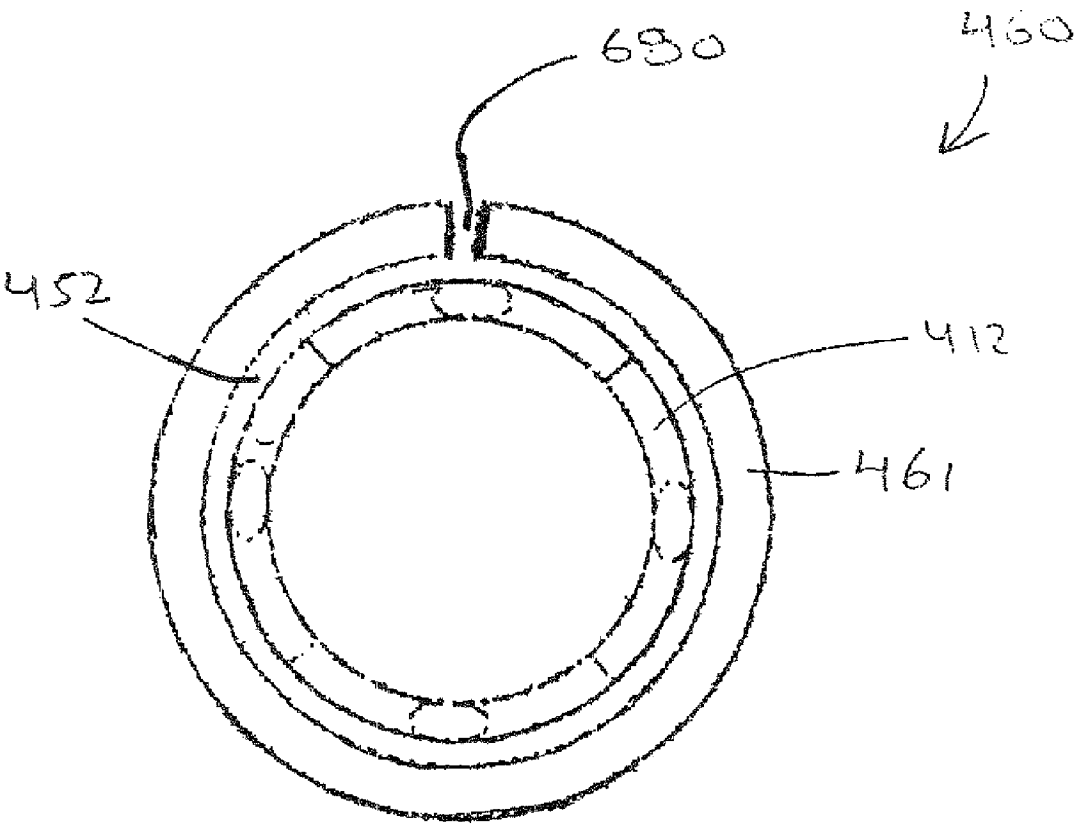
FIG. 6C is a cross-sectional view of FIG. 6A along line 6C-6C.

Referring to FIG. 6C, for example, there is illustrated a cross-sectional view of FIG. 6A along line 6C-6C showing a non-deformed portion of electrical conductor 460. Compressible member 412 may be retained within sleeve aperture 452 and spaced apart from sleeve 461.

Figure 6D:
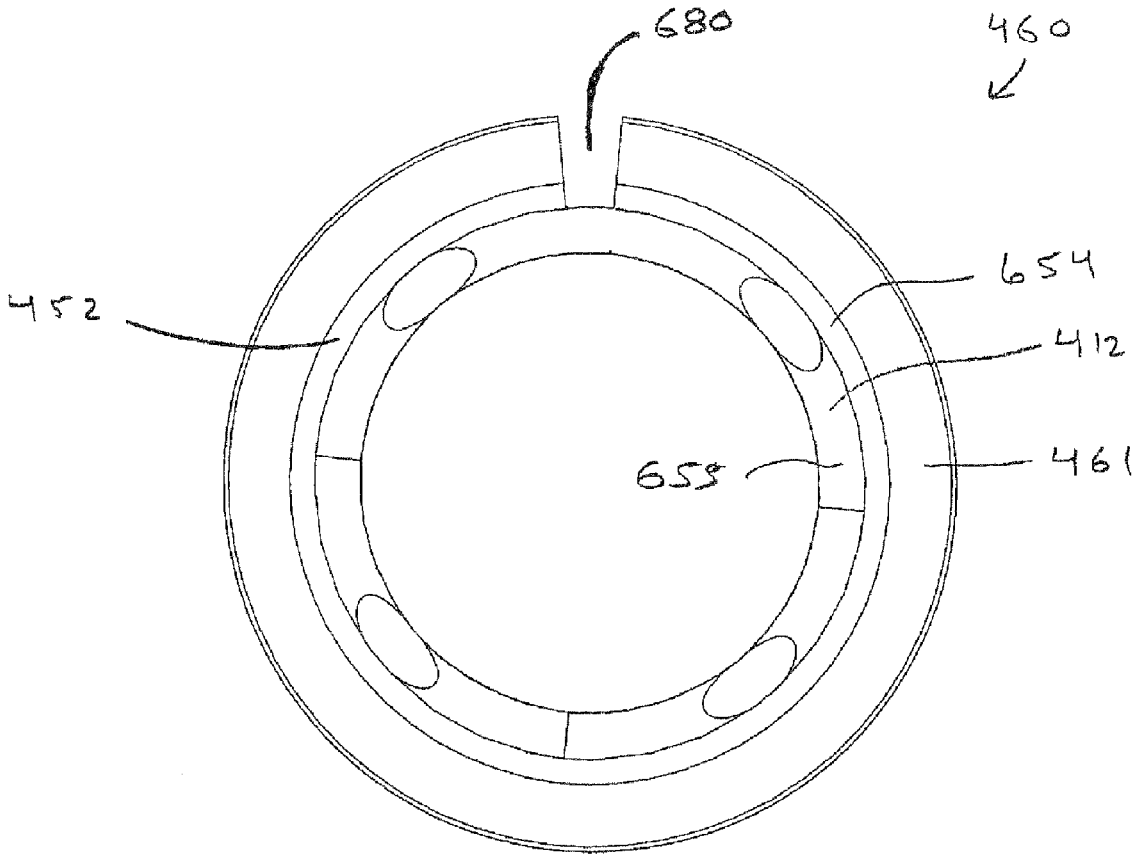
FIG. 6D is a cross-sectional view of FIG. 6A along line 6D-6D.

Referring to FIG. 6D, there is illustrated a cross-sectional view of FIG. 6A along line 6D-6D showing deformed portion 654 of electrical conductor 460. Portion 655 of compressible member 412 may be contacted by deformation 654 of sleeve 461 to retain compressible member 412 within sleeve 461.

Figure 7A:
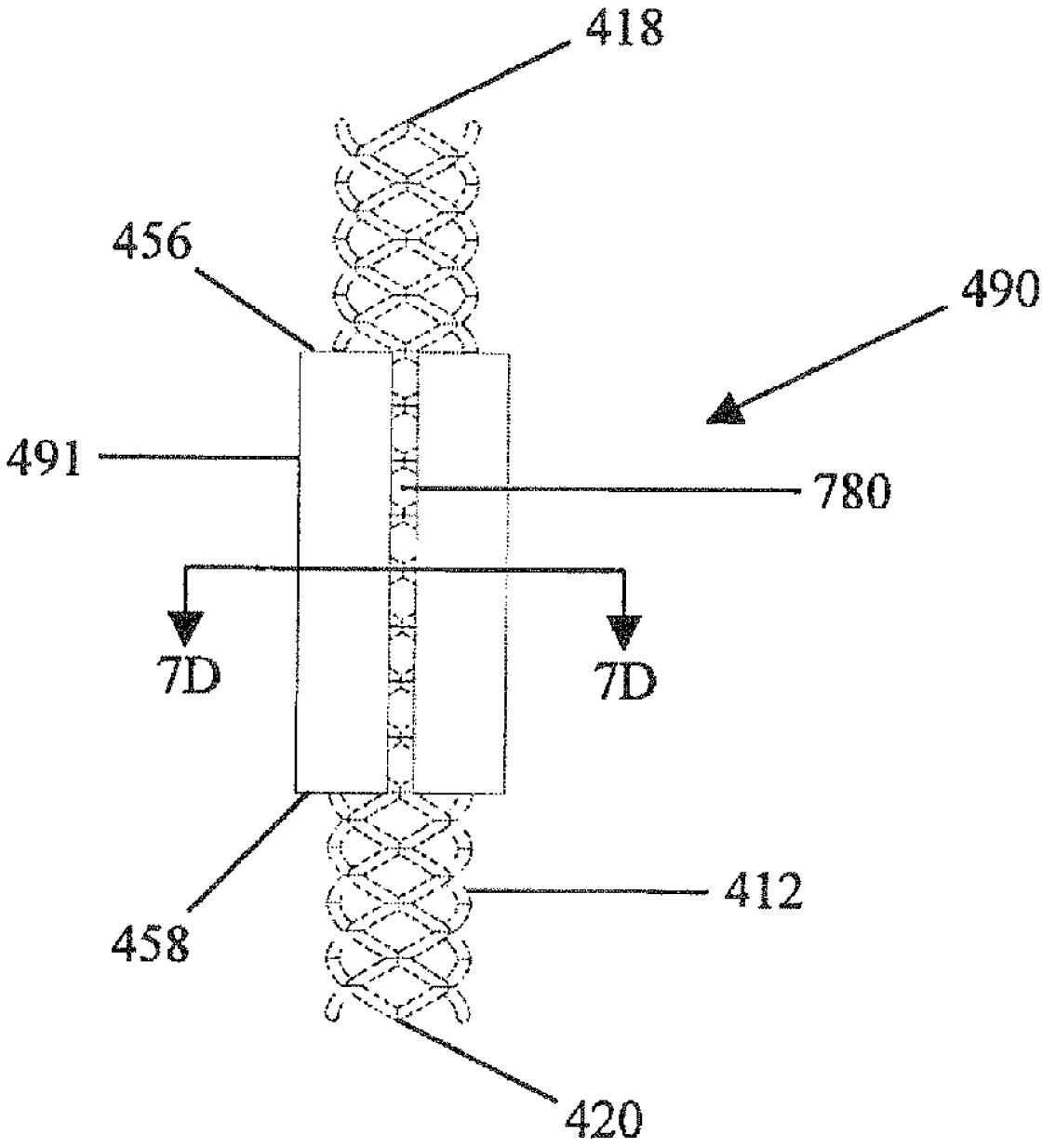
FIG. 7A is a perspective view of an electrical conductor according to an exemplary embodiment of the invention for use with an interconnect assembly for electrically connecting circuit members.
Figure 7B:
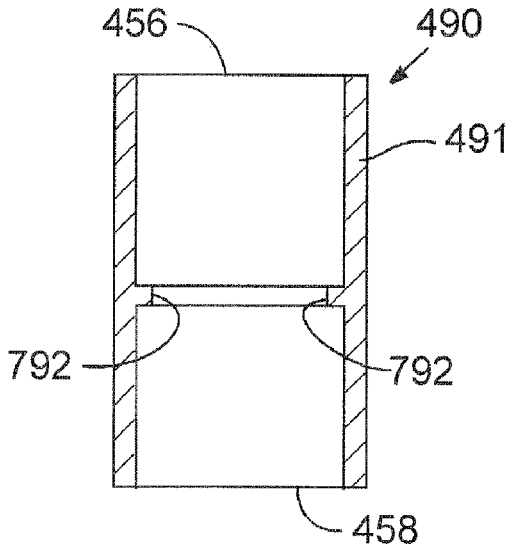
FIG. 7B is a longitudinal sectional view of the electrical conductor of FIG. 7A according to an exemplary embodiment of the invention.
Figure 7C:
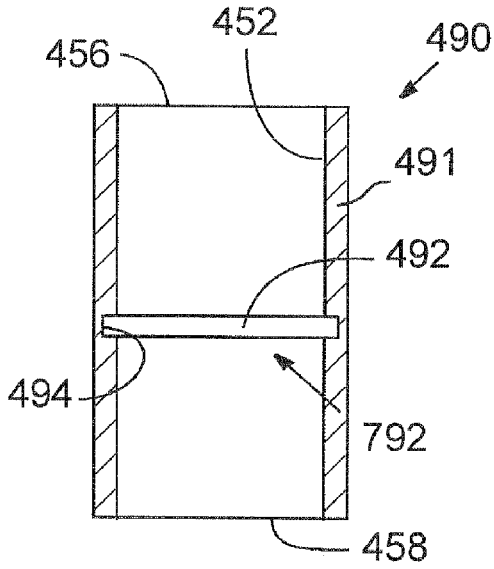
FIG. 7C is a longitudinal sectional view of the electrical conductor of FIG. 7A according to an exemplary embodiment of the invention.
Figure 7D:
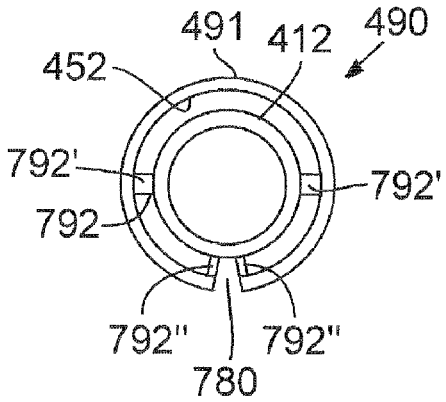
FIG. 7D is a cross-sectional view of the electrical conductor of FIG. 7A along line 7D-7D.

Specifically now referring to FIG. 7A, according to yet another exemplary embodiment of the present invention, there is illustrated third electrical conductor 490 having compressible member 412 retained within sleeve 491 by internal deformation(s) 792; 492 (see FIGS. 7B, 7C and 7D, for example). Sleeve 491 includes upper and lower ends 456, 458 and compressible member 412 includes upper and lower ends 418, 420 which also defines the upper and lower ends 418, 420 of third conductor 490. Third conductor 490 further defines longitudinal slot/opening 780 that extends at least part way between opposing ends 456, 458 of sleeve 491 and may extend completely from opposing ends 456, 458 as illustrated, for example.

Longitudinal slot 780 may serve to permit a greater reduction in the overall circumference of sleeve 491, constricting sleeve 491 when third conductor 490 is placed within aperture 448 of carrier 442 (see below). Longitudinal slot 780 and deformation(s) 792; 492 may be sized such that when conductor 460 is placed within carrier aperture 448 and longitudinal slot 780 may be reduced, thus reducing the overall circumference of sleeve 491 to constrict sleeve 491, compressible member 412 may not be appreciably contacted by the interior of constricted sleeve 491 except at deformation(s) 792; 492.

Deformation(s) 492 may be an internal, essentially circumferential, flange 492 as illustrated in FIG. 7C, for example, or, in an alternate exemplary embodiment, deformation(s) 792 may be one or more internal projections or tabs 792', 792" for example as illustrated in FIGS. 7B and 7D.

Referring to FIG. 7B, there is illustrated a longitudinal sectional view of FIG. 7A, where deformation 792 may be an integral circumferential flange that may be machined during the manufacture of sleeve 491. Longitudinal slot 780 may then be formed, removing the portion of the integral flange at longitudinal slot 780.

Referring to FIG. 7C, there is illustrated a longitudinal sectional view of FIG. 7A, where deformation 792 may be separate circumferential flange 492 fitted within corresponding circumferential groove 794 either before or after formation of horizontal slot 780. In either case, the portions of circumferential flange 492/circumferential groove 794 at horizontal slot 780 are removed/not formed at slot 780.

Referring to FIG. 7D, there is illustrated, according to yet another exemplary embodiment of the present invention, a cross-sectional view along line 7D-7D of FIG. 7A, where deformation 792 is a series of one or more projections or tabs 792', 792" that are spaced apart 180°, 90° or at some other spaced arrangement for multiple tabs 792', 792". It is noted that one projection or tab 792" may comprise two portions 792" defined by longitudinal slot 780. It is contemplated that projections or tabs 792' may be offset so that longitudinal slot 780 may not define two portions of one projection or tab 792" but instead that that projection or tab 792' proximate slot 780 may be a unitary projection or tab 792' analogous to the other projections or tabs 792' distal from slot 780. It is contemplated that projections or tabs 792', 792" may be machined into sleeve 491 during manufacture and thus be integral with sleeve 491, or may be separate entities fitting into corresponding grooves within sleeve 491.

As described above, while the interconnect assemblies in accordance with the present invention have been described primarily as being adapted for electrically connecting circuit members (for example, a semiconductor package and a load board), the present invention is not limited thereto. In applications for package testing, such interconnection may require only short duration connections lasting only seconds or, alternatively, for burn-in testing for example, may last for hours or days. Certain teachings of the present invention may be applied to other technologies, for example, it should be understood that the present invention is not limited in application to package testing and may have other applications including, for example, testing of a wafer prior to singulation of devices from the wafer.

The present invention may be embodied in other specific forms without departing from the spirit or essential attributes thereof. Although the invention has been described and illustrated with respect to the exemplary embodiments thereof, it should be understood by those skilled in the art that the foregoing and various other changes, omissions and additions may be made therein and thereto, without parting from the spirit and scope of the present invention.

The invention claimed is:

1. An electrical conductor, comprising:

a compressible conductive member;

a tubular conductive sleeve, wherein the tubular conductive sleeve includes an internal deformation; and the compressible conductive member comprising a tubular lattice of interlaced wires received axially within the tubular conductive sleeve and extending outwardly from opposing ends of the tubular conductive sleeve, wherein the compressible conductive member engaged therein by the internal deformation to retain at least a portion of the compressible conductive member axially within the tubular conductive sleeve;

the tubular conductive sleeve further including means for permitting the tubular conductive sleeve to constrict about the compressible conductive member.

2. The electrical conductor of claim 1, wherein means for permitting comprises a slot.

3. The electrical conductor of claim 1, wherein the deformation comprises a crimp in a sidewall of the sleeve.

4. The electrical conductor of claim 1, wherein the deformation is disposed axially at a central portion of the sleeve.

5. The electrical conductor of claim 1, wherein the deformation is disposed axially so as to be closer to one end of the sleeve than the other end of the sleeve.

6. The electrical conductor of claim 1, wherein the deformation extends around the substantially entire inner circumference of the sleeve.

7. The electrical conductor of claim 1, wherein the sleeve further comprises at least two of the deformations.

8. The electrical conductor of claim 7, wherein the deformations are spaced approximately 180 degrees apart along an inside wall of the sleeve.

9. The electrical conductor of claim 7, wherein the deformations are spaced approximately 90 degrees apart along an inside wall of the sleeve.

10. The electrical conductor of claim 1, wherein the deformation comprises one or more internal tabs in the sleeve.

11. The electrical conductor of claim 10, wherein the sleeve further comprises one or more internal grooves and the tabs fit in the grooves.

12. The electrical conductor of claim 1, wherein the deformation comprises a substantially circumferential flange on the interior of the sleeve.

13. The electrical conductor of claim 12, wherein the sleeve further comprises a substantially circumferential groove and the flange fits within the groove.

14. An interconnect assembly, comprising:

a plurality of electrical conductors, each electrical conductor comprising:

a compressible member; and a sleeve, wherein the sleeve comprises a deformation and a longitudinal slot; the compressible member comprising a plurality of conductive interlaced wires received axially within the sleeve and extending outwardly from opposing ends of the sleeve, wherein the compressible member engaged therein by the deformation to retain at least a portion of the compressible member axially within the sleeve;

a socket member, the socket member including a plurality of first apertures, wherein each of the first apertures receives an upper portion of one of the conductors; and a retainer, the retainer including a plurality of second apertures, wherein each of the second apertures receives a lower portion of one of the conductors.

15. The interconnect assembly of claim 14, wherein each of the first and second apertures has a diameter that is larger than an outer diameter of the conductors.

16. The interconnect assembly of claim 14, wherein the conductors are press fit within the first and second apertures.

17. The interconnect assembly of claim 14, wherein the plurality of conductors are configured to electrically contact one of a ball grid array and a land grid array of electrical contacts.

18. The interconnect assembly of claim 14, wherein the first and second apertures comprise shoulders to retain the electrical conductors.

19. The interconnect assembly of claim 18, wherein the shoulders contact upper and lower portions of the sleeves.

20. The interconnect assembly of claim 14, wherein the socket member and the retainer comprise non-conductive material.

21. The interconnect assembly of claim 14, wherein the deformation comprises one of a crimp, a flange, and a tab.

22. An electrical conductor, comprising:

a sleeve;

a compressible member disposed in the sleeve and extending outwardly from opposing ends of the sleeve, wherein the compressible member comprises a plurality of conductive interlaced wires;

a longitudinal slot in the sleeve; and at least one deformation in the sleeve, the deformation configured to engage the compressible member, thereby retaining at least a portion of the compressible member in the sleeve.

* * * * *